US009376884B2

(12) United States Patent
Clarke

(10) Patent No.: US 9,376,884 B2
(45) Date of Patent: Jun. 28, 2016

(54) PACKING ELEMENT

(75) Inventor: Tim Clarke, Aberdeen (GB)

(73) Assignee: Rubberatkins Limited, Aberdeen (GB)

( * ) Notice: Subject to any disclaimer, the term of this patent is extended or adjusted under 35 U.S.C. 154(b) by 601 days.

(21) Appl. No.: 12/747,886

(22) PCT Filed: Dec. 10, 2008

(86) PCT No.: PCT/GB2008/004046

§ 371 (c)(1),
(2), (4) Date: Sep. 1, 2010

(87) PCT Pub. No.: WO2009/074780

PCT Pub. Date: Jun. 18, 2009

(65) Prior Publication Data

US 2011/0037229 A1 Feb. 17, 2011

(30) Foreign Application Priority Data

Dec. 11, 2007 (GB) ..... 0724123.5

(51) Int. Cl.
*E21B 33/128* (2006.01)
*E21B 33/12* (2006.01)

(52) U.S. Cl.
CPC ..... *E21B 33/1216* (2013.01); *E21B 33/128* (2013.01); *E21B 33/1208* (2013.01)

(58) Field of Classification Search
CPC ..... E21B 33/04; E21B 33/08; E21B 33/1216; E21B 33/128; E21B 33/1208; E21B 2033/005
USPC ..... 277/322, 328, 329, 337, 338, 341
See application file for complete search history.

(56) References Cited

U.S. PATENT DOCUMENTS

| | | | | |
|---|---|---|---|---|
| 2,743,780 | A | 5/1956 | Brown | |
| 3,381,969 | A * | 5/1968 | Crow et al. | 277/340 |
| 3,385,679 | A | 5/1968 | Current | |
| 3,784,214 | A | 1/1974 | Tamplen | |
| 4,809,989 | A * | 3/1989 | Kernal | 277/337 |
| 5,467,822 | A * | 11/1995 | Zwart | 166/179 |
| 6,182,755 | B1 * | 2/2001 | Mansure | 166/180 |
| 6,343,791 | B1 * | 2/2002 | Anyan et al. | 277/337 |
| 7,909,109 | B2 * | 3/2011 | Angman et al. | 166/387 |
| 2006/0186602 | A1 * | 8/2006 | Martin et al. | 277/338 |
| 2008/0061510 | A1 * | 3/2008 | Li et al. | 277/300 |
| 2012/0312556 | A1 * | 12/2012 | Martin et al. | 166/382 |

FOREIGN PATENT DOCUMENTS

EP 0 349 335 1/1990

OTHER PUBLICATIONS

PCT International Preliminary Report on Patentability and Written Opinion, PCT Application No. PCT/GB2008/004046, Jun. 15, 2010, ten pages.
PCT International Search Report, PCT Application No. PCT/GB2008/004046, Dec. 11, 2009, five pages.

* cited by examiner

*Primary Examiner* — Gilbert Lee
(74) *Attorney, Agent, or Firm* — Fenwick & West LLP

(57) ABSTRACT

A sealing element for a packer is described. The sealing element comprises an annular body having an internal surface defining a throughbore, the internal surface adapted to engage a mandrel having a mandrel diameter. The annular body internal surface defines first and second regions, the throughbore diameter of the regions being less than the mandrel diameter.

33 Claims, 6 Drawing Sheets

PACKING ELEMENT

FIELD OF THE INVENTION

The present invention relates to an improved packing element for use with a packer.

BACKGROUND TO THE INVENTION

Packers are commonly used in the oil and gas industry for sealing an annulus in a well bore. The annulus might exist, for example, between the well bore liner and the production tube.

Each packer generally comprises an elastomeric sealing element which, when axially compressed, expands radially outwards from a mandrel into engagement with, for example, a well bore wall.

There are drawbacks associated with some conventional packers. For example, it is known for the seal between the packing element and the casing to fail if the element has been set in a high temperature environment which subsequently cools. It is also known for the seal to fail when the packer is subject to setting backlash reducing the pressure on the sealing element.

Furthermore, packers "self-set" when there are very high flow rates flowing past an unset packer. This problem is exacerbated if the fluid can flow between the packing element and the mandrel to which it is mounted.

SUMMARY OF THE INVENTION

According to a first aspect of the present invention there is provided a sealing element for a packer comprising:

an annular body having an internal surface defining a throughbore, the internal surface adapted to engage a mandrel having a mandrel diameter, wherein the internal surface defines first and second regions, the throughbore diameter of the regions being less than the mandrel diameter.

In one embodiment, a sealing element of the present invention is adapted, at the regions, to form an interference fit with a mandrel. When used with a mandrel, the interference fit between the regions and the mandrel prevents fluid from entering between the mandrel and the element. This ensures no voids or trapped fluids are present between the mandrel and the element which gives improved control of the element material, especially at high expansion ratios and gives rise to greater stability when pumping high fluid flow rates past a packer incorporating the sealing element, while the element is in a run-in configuration. Preventing fluid from entering between the mandrel and the element will ensure no voids will be present when the packer is operating in a relatively high ambient pressure environment.

Preferably, the sealing element throughbore has an inlet and an outlet.

Preferably, one of said regions is located adjacent the inlet and the other said regions is located adjacent the outlet. Displacing the regions axially as far apart as is possible, maximises the effect the regions provide in preventing fluid flowing between the mandrel and the sealing element.

Preferably, the first and second regions are ridges.

Preferably, the ridges have tapered sides.

Preferably, the ridges have an axially extending surface. A flat surface is useful to maximise the surface area in contact with the mandrel.

Preferably, the sealing element is elastomeric.

Preferably, the sealing element is adapted to be compressed from a run-in configuration to a set configuration.

Preferably, the sealing element is compressed by the application of a setting pressure.

Preferably, in use, in the set configuration the sealing element is compressed into engagement with a well bore wall.

Preferably, the sealing element has an external surface.

Preferably, the external surface defines at least one external surface groove.

Preferably, the/each external surface groove is circumferential.

Preferably, the/each external surface groove has two walls.

Preferably, the/each external surface groove is adapted to close-up when the element is, in use, compressed into engagement with a well bore wall.

Preferably, the external surface groove walls come into engagement when the/each external surface groove closes up. Provision of one or more external surface grooves which can close up as the sealing element is compressed into engagement with a well bore wall allows for the contact pressure to be maintained in the event of the setting pressure being reduced on the sealing elements due to, for example, backlash or the sealing element cooling. In either of these eventualities, the/each external surface groove will open up, at least partially, to "soak-up" the reduction in setting pressure, whilst ensuring the seal between the sealing element and the well bore wall remains.

Preferably, there are a plurality of external surface grooves.

Preferably, the sealing element further comprises first and second back-up layers. Back-up layers are provided to prevent extrusion of the sealing element up or down the annulus as the sealing element is pressurised during setting. This can be a particular problem in high pressure or high temperature environments where the mechanical properties of the sealing element may be most rigorously tested.

Preferably, the sealing element further comprises at least one leak path for permitting fluid trapped within the/each external surface groove to drain away from the/each external surface groove during setting. Removal of fluid from the/each external surface groove permits the groove to close fully.

Preferably, at least one of said leak paths is provided by at least one of said back-up devices.

Preferably, said at least one back-up device comprises a plurality of petals.

Preferably, a leak path is provided between a pair of adjacent petals.

In one embodiment, the leak paths are removable. Making the leak paths removable ensures that the surface area of the sealing element in contact with the casing is maximised once the sealing element is set.

In an alternative embodiment, a sealing element exterior surface defines the at least one leak path.

Preferably, a sealing element internal surface defines at least one groove.

Preferably, the/each internal surface groove is located circumferentially around the internal surface.

Preferably, the/each internal surface groove is located axially between a pair of adjacent external surface grooves.

Preferably, the/each internal surface groove is adapted to receive an insert ring. Filling the internal surface groove with an insert ring prevents fluid from being trapped, or voids from occurring, between the mandrel and sealing element, giving improved control, especially with higher expansion. The presence of the internal surface groove and accompanying insert ring causes the sealing element to buckle and crease circumferentially at the internal surface at the location of the insert ring. This deformation of the sealing element causes a high concentration of contact pressure between the sealing element and well bore casing, further increasing the reliability of the packer under adverse conditions such as setting backlash and subsequent cooling.

Preferably, the sealing element further comprises an insert ring.

Preferably, the/each insert ring comprises a stiffer material than the sealing element.

In one embodiment, the/each inset ring comprises PEEK.

According to a second aspect of the present invention there is provided a sealing element for a packer comprising:

an annular element having an internal surface adapted to engage a mandrel and an external surface adapted, in use, to engage a well bore wall, wherein the external surface defines at least one circumferential groove.

In one embodiment, a sealing element of the present invention is provided with external surface grooves which are adapted to close up when the element is compressed into engagement with a well bore wall. Provision of one or more external surface grooves which can close up as the sealing element is compressed into engagement with the wall allows for the contact pressure to be maintained in the event of the setting pressure being reduced on the sealing element due to, for example axial setting backlash or the sealing element cooling. In either of these eventualities, the groove will open up, at least partially, to "soak-up" the reduction in setting pressure, whilst ensuring the seal between the sealing element and the well bore wall remains.

It will be understood that features listed in connection with the first aspect may be equally applicable to the second aspect and are not repeated for brevity.

BRIEF DESCRIPTION OF THE DRAWINGS

An embodiment of the present invention will now be described with reference to the accompanying drawings in which.

DETAILED DESCRIPTION OF THE INVENTION

Figure 1:
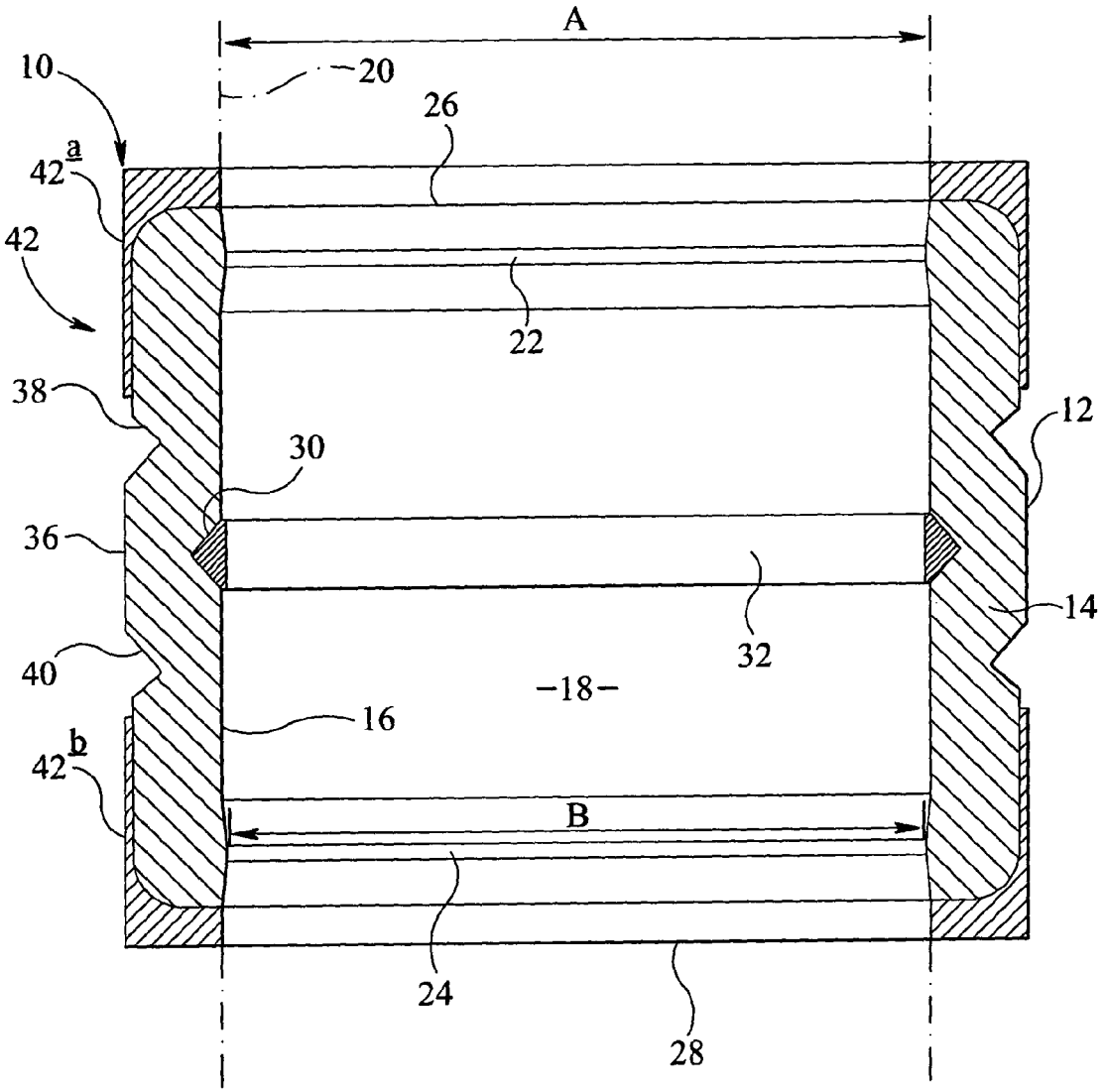
FIG. 1 is a section view of a packer incorporating a sealing element according to a first embodiment of the present invention, the sealing element being in a run-in configuration.

Reference is firstly made to FIG. 1, a section view of a packer generally indicated by reference numeral 10 incorporating an elastomeric sealing element 12 in accordance with a first embodiment of the present invention. The packer 10 is shown in a run-in configuration.

The sealing element 12 comprises an annular body 14 having an internal surface 16 defining a throughbore 18. The internal surface 16 is adapted to engage a mandrel 20 (shown in broken outline), the mandrel 20 having a mandrel diameter "A". The internal surface 16 defines first and second tapered ridges 22,24, the throughbore diameter "B" at the ridges 22,24 being less than the mandrel diameter "A". Provision of the ridges 22,24 provides an interference fit between the ridges 22,24 and the mandrel 20. This ensures no voids are present between the mandrel 20 and the element 12 which gives improved control of the element material, especially at high expansion ratios and gives rise to greater stability when pumping high fluid flow rates past the packer 10 whilst the element 12 is in the run-in configuration.

For maximum effect, the ridges 22,24 are located adjacent a throughbore inlet 26 and a throughbore outlet 28, respectively.

The sealing element internal surface 16 further comprises an internal surface groove 30 into which a PEEK insert ring 32 is fitted. The insert ring 32 provides higher contact pressures between the sealing element 12 and the well bore casing when in use.

The annular sealing element 12 further comprises an external surface 36. The external surface 36 defines first and second circumferentially extending external surface grooves 38,40. The external surface grooves 38,40 are adapted to close-up when the element 12 is, in use, compressed into engagement with a well bore wall. This will be discussed in due course. It will be noted that the internal surface groove 30 is located axially between the external surface grooves 38,40 to give a band of high contact pressure between the sealing element 12 and a well bore wall, the band of high contact pressure running circumferentially between the external surface grooves 38,40.

Figure 2:
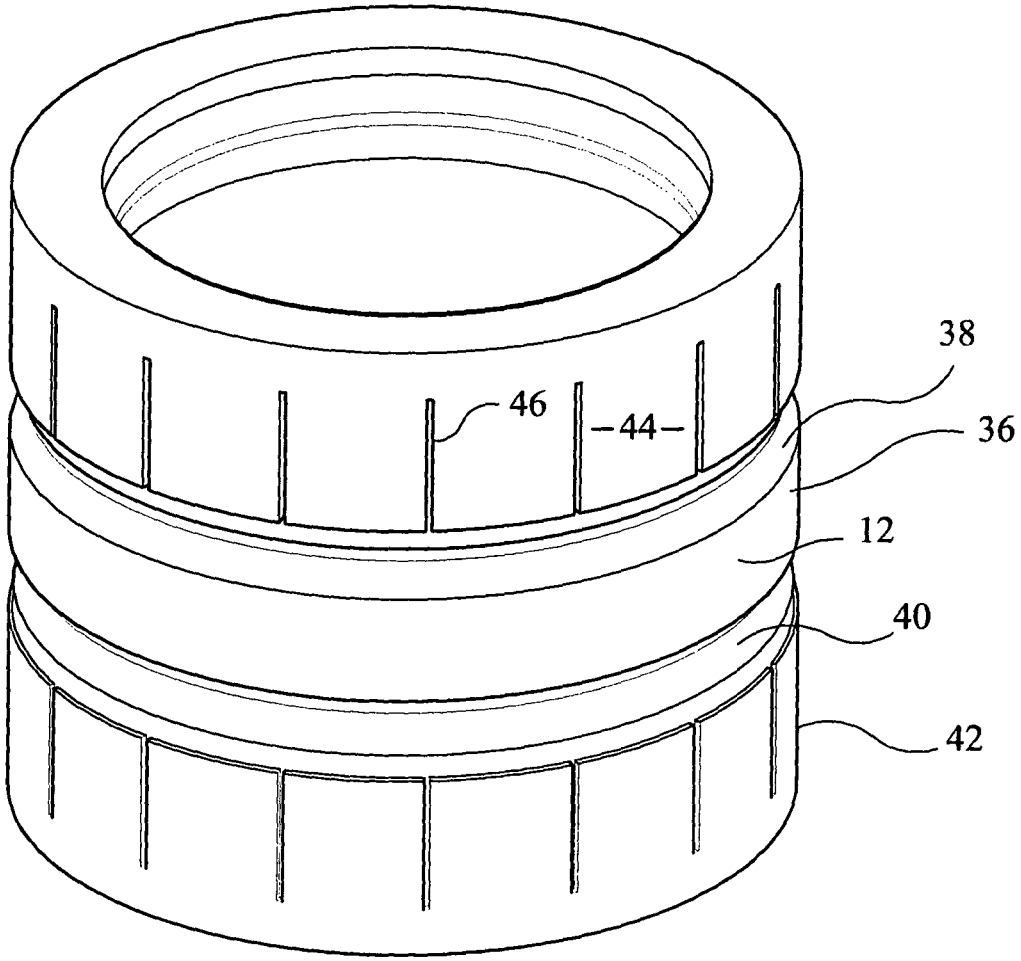
FIG. 2 is a perspective view of the packer of FIG. 1.

The packer 10 further comprises a sealing element back-up system 42 comprising a first sealing element back-up 42*a* and a second sealing element back-up 42*b*. As will be best seen from FIG. 2, each sealing element back-up 42 comprises a number of petals 44. As will be described, the slots 46 between adjacent petals 44 define leak paths to permit fluid trapped during the setting process in the external surface grooves 38,40 to escape.

Figure 3:
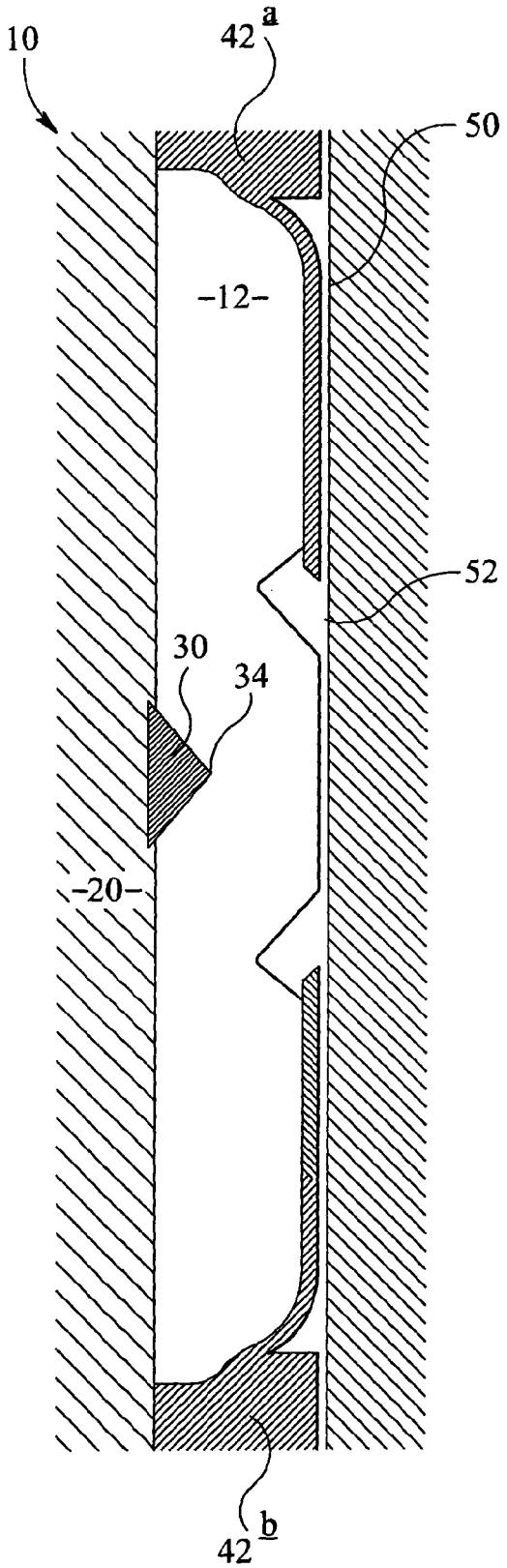
FIG. 3 is a section view of part of the packer of FIG. 1 in the run-in configuration.

The setting of the packer 10 will now be described with reference to FIGS. 3 to 6. In FIG. 3, a part of the packer 10 is shown adjacent a well bore surface 50. As can be seen, the part of the packer 10 comprises the sealing element 12, the seal back-ups 42*a*,42*b* and the mandrel 20. The packer 10 is provided to seal an annulus 52 between the well bore surface 50 and the mandrel 20.

Figure 4:
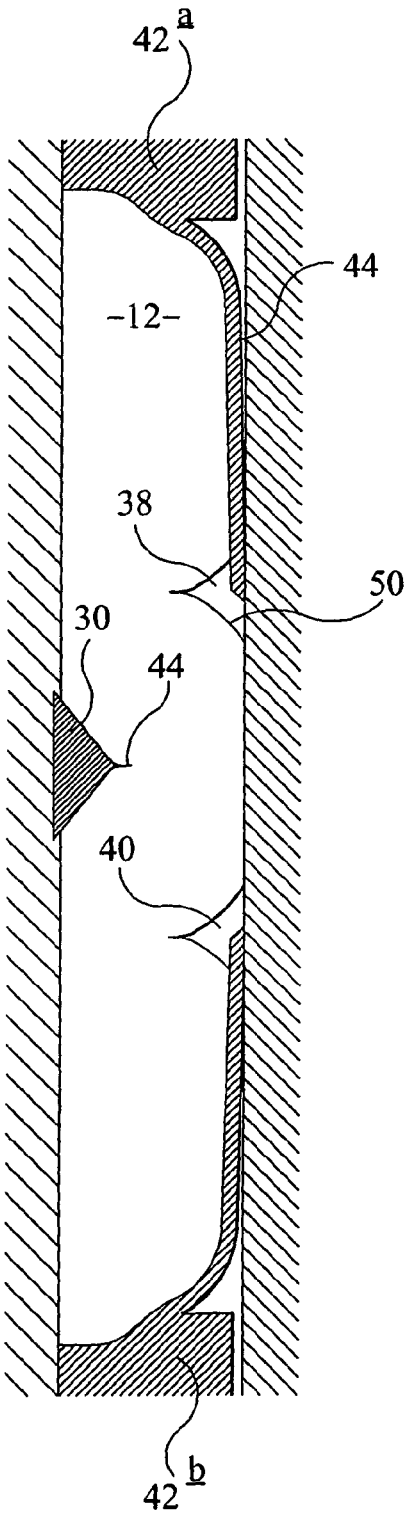
FIG. 4 is a section view of the part of the packer of FIG. 3 in a partially set configuration.

To set the packer 10, the sealing element 12 is compressed by applying an axial force of around 30,000 lbf to the packer by means of a setting tool (not shown). As can be seen in FIG. 4, the upper seal back-up 42*a* has been moved by the axial force towards the lower seal back-up 42*b*, which remains stationary, compressing the sealing element 12 into engagement with the well bore surface 50. As can be seen from FIG. 4, the external surface grooves 38,40 have started to close-up and any fluid contained in the grooves 38,40 is being compressed out of the grooves 38,40 along the slots 46 (visible in FIG. 2) between the seal back-up petals 44. It will also be noted that the elastomeric sealing element 12 is starting to fold at the tip 34 of the internal surface groove 30.

Figure 5:
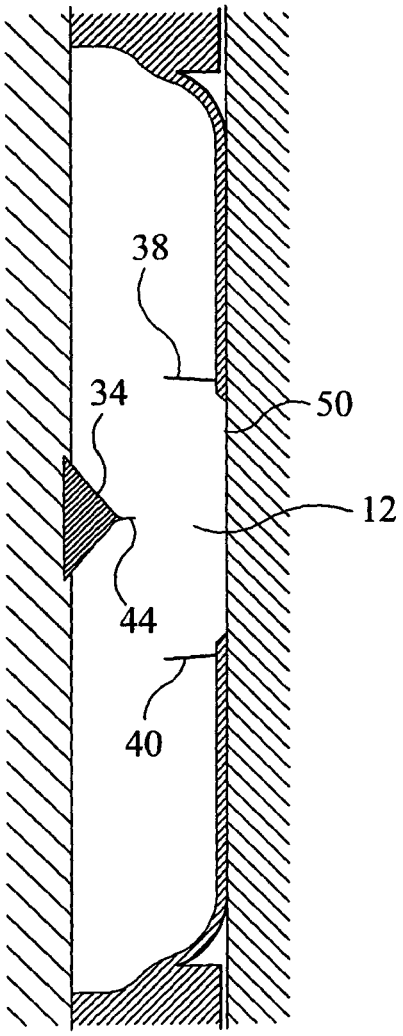
FIG. 5 is a section view of the part of the packer of FIG. 3 in a fully set configuration.
Figure 6:
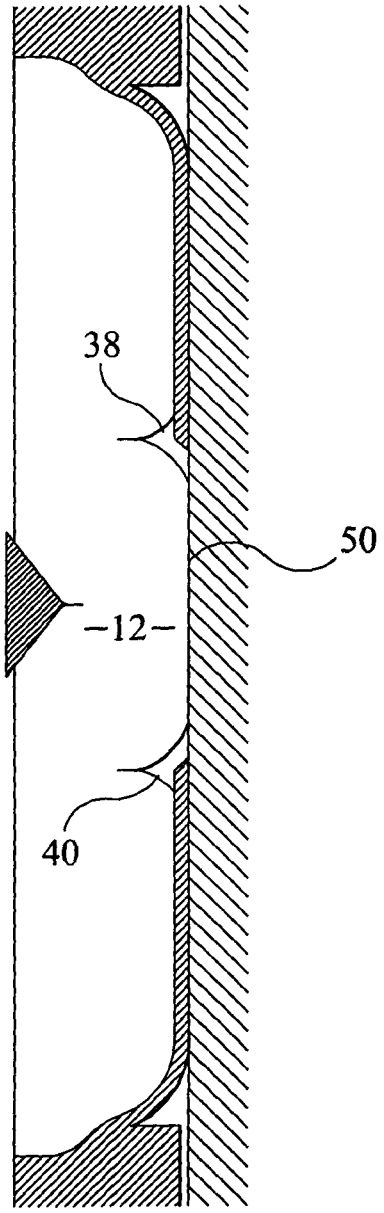
FIG. 6 is a section view of the part of the packer of FIG. 3 showing the sealing element partially relaxed due to backlash in cooling.
Figure 7:
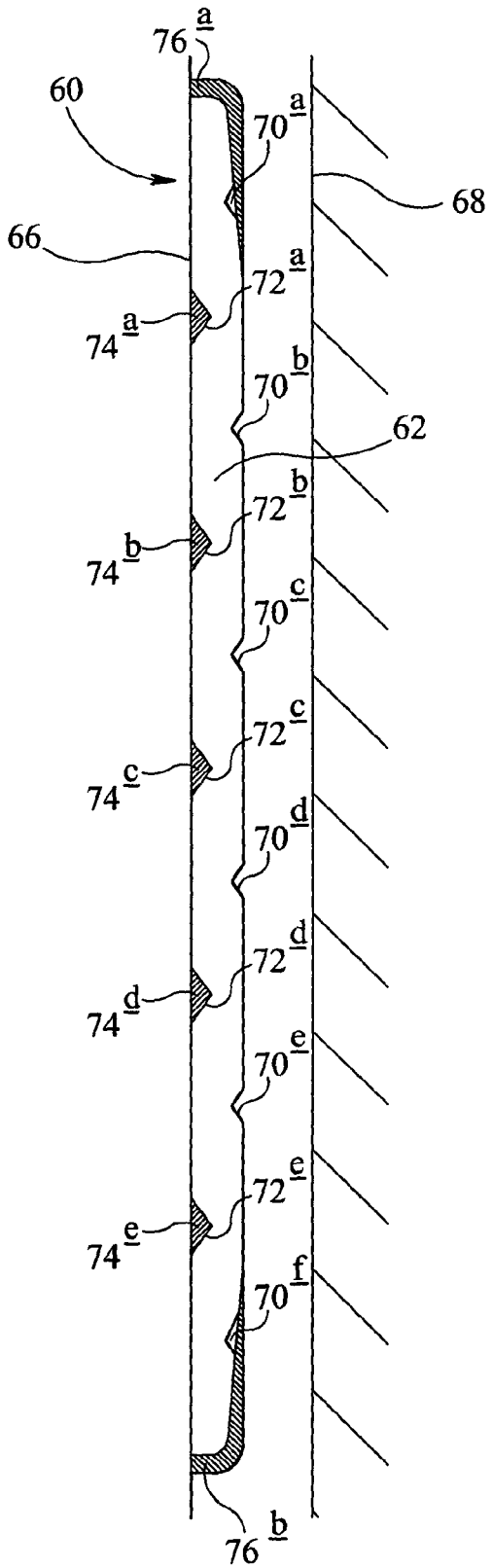
FIG. 7 is a section view of part of a packer incorporating a sealing element according to a second embodiment of the present invention in a run-in configuration.

Referring now to FIG. 5, the sealing element 12 is fully engaged with the well bore surface 50 and the external surface grooves 38,40 have fully closed. The fold 44 at the internal surface groove tip 34 is also visible.

Provision of the grooves 38,40 permits a relaxation of the packer 10 due to, for example, cooling of the sealing element 12 or backlash in the setting of the packer 10 while maintaining a seal between the packer 10 and the casing 50. This situation is visible in FIG. 6 where it can be seen that both cooling and backlash have occurred and the external surface grooves 38,40 have partially opened up but the sealing element 12 is still in sealing contact with the well bore casing 50.

A second embodiment of the present invention will now be described with reference FIGS. 7 to 12. As can be seen from FIG. 7, the packer 60 comprises a much longer sealing element 62 adapted to span a much greater well bore annulus 64 between the packer mandrel 66 and the well bore surface 68. The sealing element is provided with six external surface grooves 70*a-f* and with five internal surface grooves, 72*a-e* each incorporating an insert ring 74*a-e*.

It will be noted that the inner four external surface grooves 70*b*-70*e* are located towards the centre of the sealing element 62 and are distanced from the sealing element back-ups 76*a*, 76*b*. The sealing element back-ups 76*a*,76*b* are, therefore, unable to provide leak paths for the fluid trapped between the inner grooves 70*b-e*. To facilitate drainage of the inner grooves 70*b-e*, bleed strips 78 are provided (most clearly seen in FIGS. 10 to 12). The bleed strips 78 are pinned to a bleed strip collar 80 and each bleed strip 78 is connected to the surface by a wire 82, the purpose of which will be discussed in due course.

Figure 8:
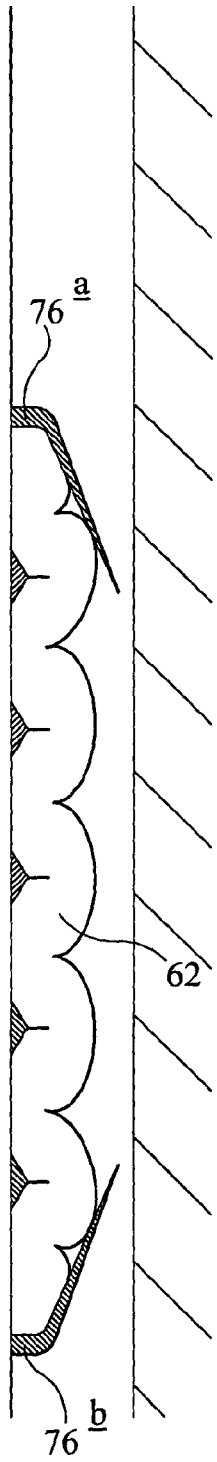
FIG. 8 is a section view of the part of the packer of FIG. 7 in a partially set configuration.
Figure 9:
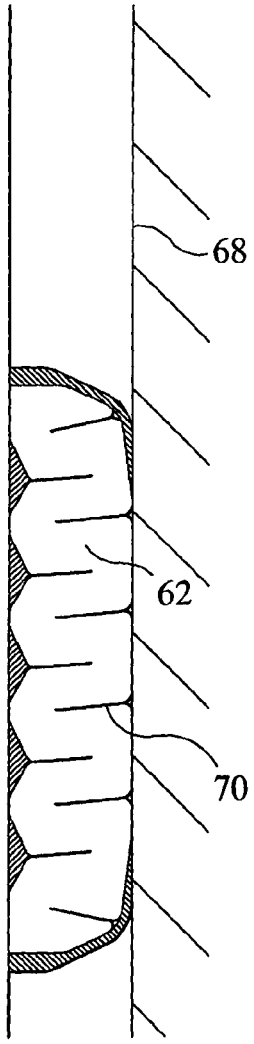
FIG. 9 is a section view of the part of the packer of FIG. 7 in a fully set configuration.
Figure 10:
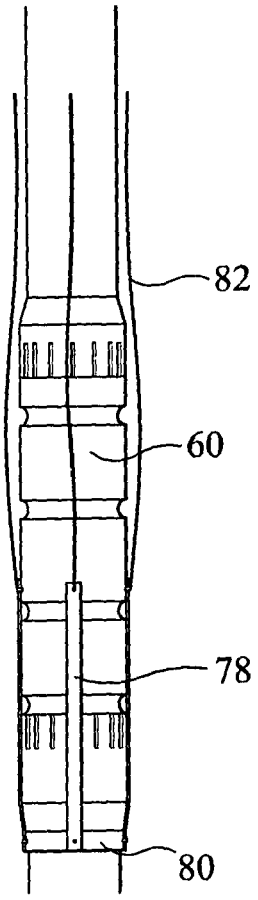
FIG. 10 is a front view of the packer of FIG. 7 in a run-in configuration.

To commence the setting of the packer 60, the sealing element 62 is compressed (FIG. 8). During this process the lower seal back-up 76*b* remains fixed and the upper seal back-up 76*a* moves axially towards the lower seal back-up 76*b*. This compression continues until the position shown in FIGS. 9 and 11 in which the sealing element 62 is fully compressed and the external surface grooves 70 have fully closed. The fluid contained in the inner external surface grooves 70*b-e* has escaped along the bleed strips 78.

Figure 11:
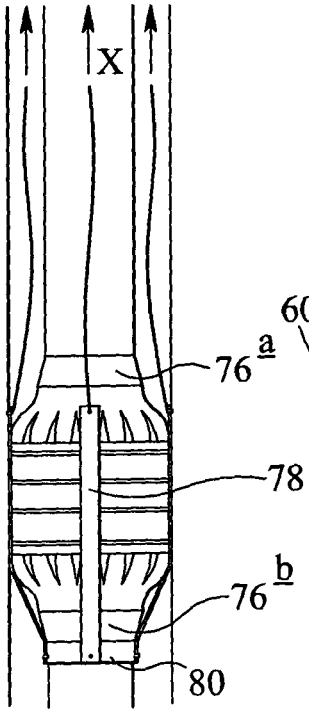
FIG. 11 is a front view of the packer of FIG. 7 in a fully set configuration.
Figure 12:
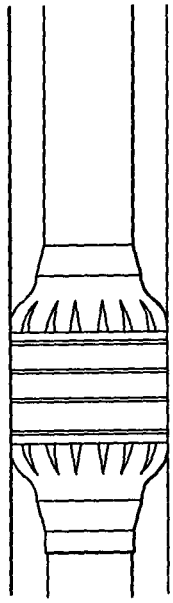
FIG. 12 is a front view of the packer in a fully set configuration with the bleed strips removed.

The bleed strips 78 are then removed from the surface by applying a pulling force in the direction of the arrows X on FIG. 11 causing the bleed strips 78 to shear from the collar 80 such that the bleed strips 78 are recovered to surface. The packer 60 is then fully set in the position shown in FIG. 12. If backlash or cooling occur, the grooves 70 may open up slightly but the sealing element will remain engaged with the well bore surface 68.

Various modifications and improvements may be made to the above described embodiments without departing from the scope of the invention. For example, although bleed strips are shown to provide a leak path for the high expansion second embodiment, these may not be necessary. In the second embodiment, the seal back-ups 76 could extend further along the seal element 62 to provide a leak path for the outer four external surface grooves at end 70*a,b,e,f*. The middle two external surface grooves 70*c-d* may not close fully due to trapped fully but the provision of other groves 70*a,b,e,f* which are substantially fully closed will in some circumstances be sufficient to ensure the seal is maintained between the packer 60 and the well bore surface 68 in the event of the sealing element partially relaxing due to cooling of the sealing element 62 or axial setting backlash.

The invention claimed is:

1. A sealing element for a packer comprising:

an annular element having an internal surface adapted to engage a mandrel and an external surface adapted, in use, to engage a bore wall, wherein the external surface defines at least one circumferential groove, the annular element configured such that the at least one circumferential groove closes up when a setting pressure is applied to cause the sealing element to compress into engagement with a bore wall and at least partially opens up in response to a reduction in the setting pressure while maintaining said sealing contact with the bore wall.

2. The sealing element of claim 1, wherein the internal surface of the annular element defines first and second regions, a throughbore diameter of the first and second regions being less than a diameter of the mandrel.

3. The sealing element of claim 2, wherein the throughbore diameter of the first and second regions is less than the mandrel diameter and a remainder of the internal surface of the sealing element to provide an interference fit between the first and second regions of the internal surface and the mandrel.

4. The sealing element of claim 2, wherein a throughbore of the sealing element has an inlet and an outlet.

5. The sealing element of claim 2, wherein a throughbore of the sealing element has an inlet and an outlet, and wherein one of said first and second regions is located adjacent the inlet and the other of said first and second regions is located adjacent the outlet.

6. The sealing element of claim 2, wherein the first and second regions are ridges.

7. The sealing element of claim 6, wherein the ridges have tapered sides.

8. The sealing element of claim 6, wherein the ridges have an axially extending surface.

9. The sealing element of claim 1, wherein the sealing element is elastomeric.

10. The sealing element of claim 1, wherein the sealing element is adapted to be compressed from a run-in configuration to a set configuration.

11. The sealing element of claim 10, wherein the sealing element is compressed by the application of the setting pressure.

12. The sealing element of claim 10, wherein in the set configuration the sealing element is compressed into engagement with a well bore wall.

13. The sealing element of claim 1, wherein the at least one external surface groove has two walls.

14. The sealing element of claim 13, wherein the external surface groove walls come into engagement when the at least one external surface groove closes up.

15. The sealing element of claim 1, wherein there are a plurality of the external surface grooves.

16. The sealing element of claim 1, wherein the sealing element further comprises at least one back-up device, said at least one back-up device comprising first and second back-up layers.

17. The sealing element of claim 16, wherein said at least one back-up device comprises a plurality of petals.

18. The sealing element of claim 17, wherein one of:

the sealing element further comprises at least one leak path for permitting fluid trapped within the at least one external surface groove to drain away from the at least one external surface groove during setting, wherein at least one leak path is provided by said at least one back-up device between a pair of adjacent petals;

the sealing element further comprises at least one leak path for permitting fluid trapped within the at least one external surface groove to drain away from the at least one external surface groove during setting, wherein at least one leak path is provided by said at least one back-up device between a pair of adjacent petals, and wherein the at least one least path is removable; and the sealing element further comprises at least one leak path for permitting fluid trapped within the at least one external surface groove to drain away from the at least one external surface groove during setting, wherein at least one leak path is provided by said at least one back-up device between a pair of adjacent petals, and wherein the sealing element exterior surface defines the at least one leak path.

19. The sealing element of claim 16, wherein one of:

the sealing element further comprises at least one leak path for permitting fluid trapped within the at least one external surface groove to drain away from the at least one external surface groove during setting, wherein the at least one leak path is provided by said at least one back-up device; and the sealing element further comprises at least one leak path for permitting fluid trapped within the at least one external surface groove to drain away from the at least one external surface groove during setting, wherein the at least one leak path is provided by said at least one back-up device, and wherein the at least one leak path is removable; and the sealing element further comprises at least one leak path for permitting fluid trapped within the at least one external surface groove to drain away from the at least one external surface groove during setting, wherein the at least one leak path is provided by said at least one back-up device, and wherein the sealing element exterior surface defines the at least one leak path.

20. The sealing element of claim 1, wherein one of:

the sealing element further comprises at least one leak path for permitting fluid trapped within the at least one external surface groove to drain away from the at least one external surface groove during setting;

the sealing element further comprises at least one leak path for permitting fluid trapped within the at least one external surface groove to drain away from the at least one external surface groove during setting, and wherein the at least one leak path is removable; and the sealing element further comprises at least one leak path for permitting fluid trapped within the at least one external surface groove to drain away from the at least one external surface groove during setting, and wherein the sealing element exterior surface defines the at least one leak path.

21. The sealing element of claim 1, wherein the sealing element internal surface defines at least one groove.

22. The sealing element of claim 21, wherein the at least one internal surface groove is located circumferentially around the internal surface.

23. The sealing element of claim 21, wherein the at least one internal surface groove is located axially between a pair of adjacent external surface grooves.

24. The sealing element of claim 21, wherein the sealing element further comprises an insert ring, and wherein the at least one internal surface groove is adapted to receive an insert ring.

25. The sealing element of claim 1, wherein the sealing element further comprises an insert ring.

26. The sealing element of claim 25, wherein the insert ring comprises a stiffer material than the sealing element.

27. The sealing element of claim 25, wherein the insert ring comprises PEEK.

28. The sealing element of claim 1, wherein said annular element comprises an annular elastomeric body, the internal surface of the elastomeric body adapted to engage the mandrel.

29. The sealing element of claim 1, wherein the run-in configuration defines an unset configuration.

30. The sealing element of claim 1, wherein the run-in configuration defines an unactivated configuration.

31. The sealing element of claim 1, wherein the seal element is adjacent to a bore wall in the run-in configuration.

32. A packer comprising:

a mandrel having a mandrel diameter; and a sealing element according to claim 1.

33. A sealing element for a packer comprising:

an annular body having an internal surface defining a throughbore, the internal surface adapted to engage a mandrel having a mandrel diameter, wherein the internal surface defines first and second regions, the throughbore diameter of the regions being less than the mandrel diameter, wherein the sealing element internal surface defines at least one groove and the sealing element further comprises an insert ring, the groove defined by said sealing element internal surface adapted to received said insert ring.

* * * * *